US006792788B2

(12) United States Patent
Futamura et al.

(10) Patent No.: US 6,792,788 B2
(45) Date of Patent: Sep. 21, 2004

(54) PRESSURIZER

(75) Inventors: Shoji Futamura, Atsugi (JP); Hiromitsu Kaneko, Atsugi (JP)

(73) Assignee: Institute of Technology Precision Electrical Discharge Work's, Kanagawa (JP)

( * ) Notice: Subject to any disclaimer, the term of this patent is extended or adjusted under 35 U.S.C. 154(b) by 169 days.

(21) Appl. No.: 10/009,788

(22) PCT Filed: Feb. 15, 2001

(86) PCT No.: PCT/JP01/01075

§ 371 (c)(1),
(2), (4) Date: Dec. 3, 2001

(87) PCT Pub. No.: WO02/064355

PCT Pub. Date: Aug. 22, 2002

(65) Prior Publication Data

US 2003/0019267 A1 Jan. 30, 2003

(51) Int. Cl.[7] ..... B21J 9/18; B30B 15/14

(52) U.S. Cl. ..... 72/453.03; 72/453.02; 100/270

(58) Field of Search ..... 72/454, 453.03, 72/453.04, 453.09, 453.02; 100/231, 288, 289, 271, 270

(56) References Cited

U.S. PATENT DOCUMENTS 2,128,152 A * 8/1938 MacMillin ..... 72/453.03
3,830,615 A * 8/1974 Walchhuetter ..... 72/453.04
4,646,555 A * 3/1987 Postupack ..... 72/453.03
6,520,077 B1 * 2/2003 Minagawa et al. ..... 100/270

FOREIGN PATENT DOCUMENTS

| | | |
|---|---|---|
| JP | 58-163617 | 9/1983 |
| JP | 61-106221 | 5/1986 |
| JP | 4-47520 | 4/1992 |
| JP | 6-54498 | 7/1994 |
| JP | 6-218591 | 8/1994 |
| JP | 10-015699 | 1/1998 |
| JP | 11-221700 | 8/1999 |
| JP | 11-226796 | 8/1999 |

* cited by examiner

*Primary Examiner*—David B. Jones
(74) *Attorney, Agent, or Firm*—McGlew and Tuttle, P.C.

(57) ABSTRACT

Disclosed is a high-accuracy pressure device for working that has a large pressing force and requires small driving energy.

The pressure device comprises: a base plate, a support plate spaced at a prescribed distance from the base plate, a first slider and a second slider; the first slider and the second slider being formed so that the two can move between the base plate and the support plate in a direction orthogonal to the base plate and support plate and are capable of relative movement with each other in that direction, a position sensor for detecting the moving position of the second slider; a first drive means for driving the first slider; a second drive means for driving the second slider; and a central processing unit which controls the first drive means and second drive means and receives and processes position signals from the position sensor.

13 Claims, 8 Drawing Sheets

61
66
67
68
69
70
71
72
73
64
65
a
b
c

PRESSURIZER

BACKGROUND OF THE INVENTION

1. Field of the Invention

The present invention relates to a pressure device, such as a pressing machine used, for example, in sheet metal working and, more particularly, to a pressure device which is capable of pressing operation requiring accurate position control and which, at the same time, involves a large pressing force and yet small driving energy.

2. Description of the Related Art

In a conventional type of press working machine, a hydraulic cylinder is widely used as a means of driving a ram that comes in contact with a workpiece and, in particular, an oil hydraulic cylinder is frequently used. In this type of hydraulic cylinder-operated pressing machine, it is necessary to perform press working as shown in FIG. 6, that is, working is conducted with the distance between a ram and a table kept constant.

FIG. 6 is an explanatory drawing of conventional working. In FIG. 6, numeral 31 indicates a table. With respect to this table 31, a ram 32 of a pressing machine moves up and down by use of an oil hydraulic cylinder, for example, to perform the press working of a workpiece 33. In order to accurately work the workpiece 33 to a thickness dimension t with this arrangement, the bottom end of the ram 32 is provided with projections 35 that have a height equal to the workpiece thickness t and protrude downward from a working surface 34.

With this arrangement, when the ram 32 is operated downward, the working surface 34 can perform prescribed working of the workpiece 33. Keeping the projections 35 of the ram 32 abutting against the table 31 allows the thickness dimension t of the workpiece 33 to be accurately maintained, free from dimensional variations. Thus, the working accuracy of the workpiece 33 can be improved.

The working method shown in FIG. 6, however, poses the following problem although the working accuracy can be improved by this method. That is, impact noises are inevitably generated because the ram 23 hits against the workpiece 33 in an impacting manner and because the projections 35 of the ram 32 also violently hit against the table 31. In particular, in the case of high-speed working where the working frequency of the ram 32 per unit time is high, noises become so great that they impair the working environment.

On the other hand, working by use of an electrically-driven press has so far been practiced, and it is known that this working method is favorable for preventing the generation of noises caused by the working as shown in FIG. 6 by the above hydraulic press, etc.

FIG. 7 is a longitudinal sectional view of essential portions of an example of the conventional electrically-driven press. This drawing is contained in Japanese Published Unexamined Patent Application No. Hei-6(1994)-218591, for example. In FIG. 7, reference numeral 41 indicates a pressing force generating means. The pressing force generating means 41 is housed within a head frame 44 installed on a column 43, which is formed integrally with a table 42.

Numeral 45 indicates a tubular body. The tubular body 45 is installed within the head frame 44 and is provided with a bearing part 46 at the top end thereof. Numeral 47 indicates a screw shaft. The top end of the screw shaft 47 is supported by the bearing part 46 in a suspended state. Numeral 48 indicates a ram shaft, which is formed in a hollow cylindrical shape. A nut 49, which engages with the screw shaft 47, is fixed to the top end of the ram shaft 48. The ram shaft 48 is installed so that it can move vertically within the tubular body 45. Numeral 50 indicates a pressing element detachably installed in the bottom end portion of the ram shaft 48. The screw shaft 47 and nut 49 are in ball-screw engagement.

Next, numeral 51 indicates a sliding guide post. The sliding guide post 51 comprises a guide portion 52 installed within the head frame 44, a sliding rod 53, and a connecting plate 54 installed between the ram shaft 48 and the bottom end of the sliding rod 53. Numeral 55 indicates a drive motor. The drive motor 55 is installed within the head frame 44 and drives the screw shaft 47 in both forward and reverse directions via a pulley 56 and a belt 57, which are installed in the top end portion of the screw shaft 47.

Note that measuring means, central processing unit, etc., which are not shown in the drawing, set the start and stop positions of the pressing element 50 and the rotational speed of the drive motor 55, give the drive motor 55 instructions for rotation in the forward and reverse directions, etc.

With the above construction of the electrically-operated press, as the screw shaft 47 is rotated by the operation of the drive motor 55 via the belt 57 and the pulley 56, the ram shaft 48 having the nut 49 fixed to the upper end thereof descends and the pressing element 50 abuts against a workpiece W with a pressing force in a preset position as shown by chain lines to perform the prescribed press working. After the completion of press working, the ram shaft 48 and pressing element 50 ascend by the reverse rotation of the drive motor 55 and return to the initial positions. By repeating the above operation, the prescribed press working can be accomplished on a plurality of workpieces W.

When an electrically-driven press as mentioned above is used, it is possible to perform working without generating noises. However, a conventional electrically-driven press poses problems as described below. Because the pressing force applied to the workpiece W is determined by the capacity of the drive motor 55, large-capacity pressing machines require the drive motor 55 having a large capacity. Furthermore, in a large-capacity and large-size pressing machine, moving parts including the ram shaft 48 and pressing element 50 also become large both in size and weight. As a result, the driving energy necessary for the repeated vertical movements of the moving parts also becomes large, adding momentum to the undesirable trend toward larger size design and larger capacity design of drive motor 55.

Furthermore, it is difficult to precisely position the pressing element 50 in a prescribed position (height h), for example, above the table 42, and positioning errors frequently occur. Since the pressing element 50 is caused to move vertically by the movement of the nut 49 engaging with the screw shaft 47 as the screw shaft 47 is rotated, it is necessary to increase the number of revolutions and/or the screw pitch of the screw shaft 47 in order to shorten the working cycle time. This results in a decrease in the positioning accuracy of the pressing body 50. On the other hand, reducing the number of revolutions and/or the screw pitch of the screw shaft 47 in order to improve the locating accuracy of the pressing element 50 could increase the time required for the vertical movement of the pressing element 50 and therefore the working cycle time accordingly, resulting in a decrease in working efficiency.

Although there can be another arrangement where the vertical movement of the pressing element 50 is accomplished by use of a plurality of drive means, this requires a complicated structure and a large-sized unit, and it is difficult to smoothly perform the control of a plurality of drive means. Therefore, this method has not been put to practical use.

SUMMARY OF THE INVENTION

This invention is intended to overcome the aforementioned problems inherent in the prior art, and it is therefore an object of the present invention to provide a pressure device for press working having high working accuracy and a large pressing force and requiring small driving energy.

To solve the above problems, the present invention adopts a technical means that comprises: a base plate; a support plate spaced at a predetermined distance from the base plate; a first slider and a second slider, both being formed so that they can move between the base plate and the support plate in a direction orthogonal to the base plate and support plate and are capable of relative movement with each other in the above direction, a position sensor for detecting the moving position of the second slider; a first drive means for driving the first slider; a second drive means for driving the second slider; and a central processing unit which controls the first drive means and second drive means and receives and processes position signals from the position sensor. In this technical means, a workpiece placed between the second slider and the base plate is pressed by moving the first slider and second slider to prescribed positions by use of the first drive means and by moving the second slider to a prescribed position by use of the second drive means. Incidentally, the above drive means can include a known speed reduction mechanism having a plurality of gear groups.

In the present invention, the base plate and support plate can be disposed parallel to the horizontal plane and the first slider and second slider can be disposed so that they can move in a vertical direction.

Next, in the present invention, the first drive means may be formed as a crank mechanism and the second drive means as a mechanism comprising a screw pair.

Furthermore, in the present invention, the first drive means and second drive means each can be formed as a mechanism comprising a screw pair.

In this case, the screw in the first drive means can be formed as a ball screw.

Furthermore, in the present invention, the first slider and second slider can be formed so that the relationship between the amount of movement, $m_1$, of the first slider per unit of time and the amount of movement, $m_2$, of the second slider per unit of time is expressed by $m_1>m_2$.

Furthermore, in the present invention, motors in the first drive means and second drive means can be formed as servo motors.

DETAILED DESCRIPTION OF THE PREFERRED EMBODIMENTS

Figure 1:
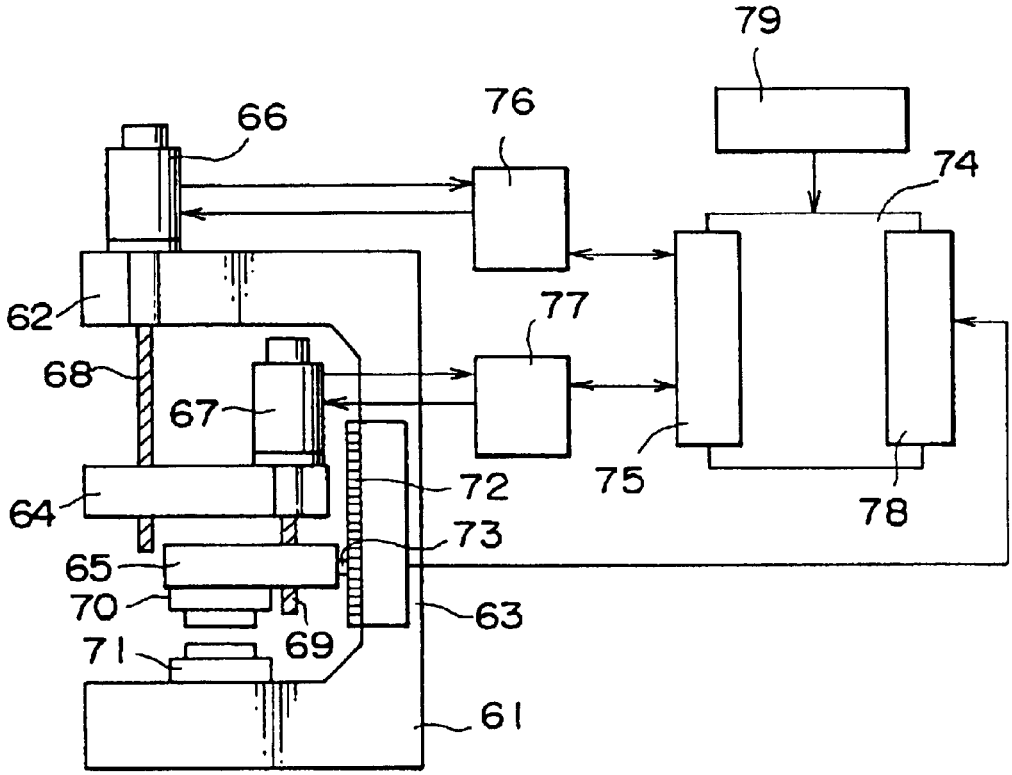
FIG. 1 is an explanatory drawing of the construction of essential portions of a first embodiment of the present invention.

FIG. 1 is an explanatory drawing of the construction of essential portions of a first embodiment of the present invention. In FIG. 1, numerals 61 and 62 indicate a base plate and a support plate, respectively. The base plate 61 and support plate 62 are formed, for example, in rectangular flat-plate shape, integrally constructed parallel to each other, and spaced by a column 63 from each other at a prescribed distance. Numerals 64 and 65 indicate a first slider and a second slider, respectively. The fist slider 64 and second slider 65, which are interposed between the base plate 61 and support plate 62, are formed so that they can move vertically and are capable of vertical relative movement with each other.

Numerals 66 and 67 indicate a first motor and a second motor, respectively. The first motor 66 and second motor 67 are formed as servo motors, such as pulse motors, are installed on the support plate 62 and on the first slider 64, respectively, and are each fabricated in such a manner as to drive screw shafts 68 and 69 in forward and reverse directions. The screw shafts 68 and 69 are engaged with a nut member or female screw member (both not shown in the figure) provided within the first slider 64 and the second slider 64, respectively, in a non-rotatable fashion, so as to vertically drive the first slider 64 and the second slider 65, respectively, thereby forming a first drive means and a second drive means, respectively. Numerals 70 and 71 indicate dies. The dies 70 and 71 are detachably installed facing the second slider 65 and the base plate 61, respectively, thereby forming a pair or a set of dies. Numeral 72 indicates a linear scale, installed on the column 63, for example, and faces a detecting element 73 installed on the second slider 65, thereby forming a position sensor of the second slider 65.

In this case, although the position sensor directly detects the position of the second slider 65, it can also indirectly detect the position of the first slider 64 by recognizing the relative position the first slider 64 connected to the second slider 65. Therefore, the above position sensor serves as a position sensor common to the first slider 64 and the second slider 65.

The screw pair formed screw shaft 68 constituting the above first drive means and the female screw engaging with the screw shaft 68 can be formed as a ball screw. Furthermore, the above drive means can include a known speed reduction mechanism having a plurality of gear groups between the first motor 66 and the second motor 67.

Next, numeral 74 indicates a central processing unit (CPU). The central processing unit 74 sends signals to the first motor 66 and second motor 67 by an interface 75 via a first driver 76 and a second driver 77 and thereby controls the driving of the two motors 66 and 67. Numeral 78 indicates a pulse counter. The pulse counter 78 counts pulse signals sent from the position sensor comprising the detecting element 73 and linear scale 72 and sends the pulse signals to the central processing unit 74. The signals are received and stored by the central processing unit 74 and are processed for the control of the first motor 66 and second motor 67. Numeral 79 indicates an input device. The input device 79 inputs the movement data of the first slider 64 and second slider 65 to the central processing unit 74.

Figure 2:
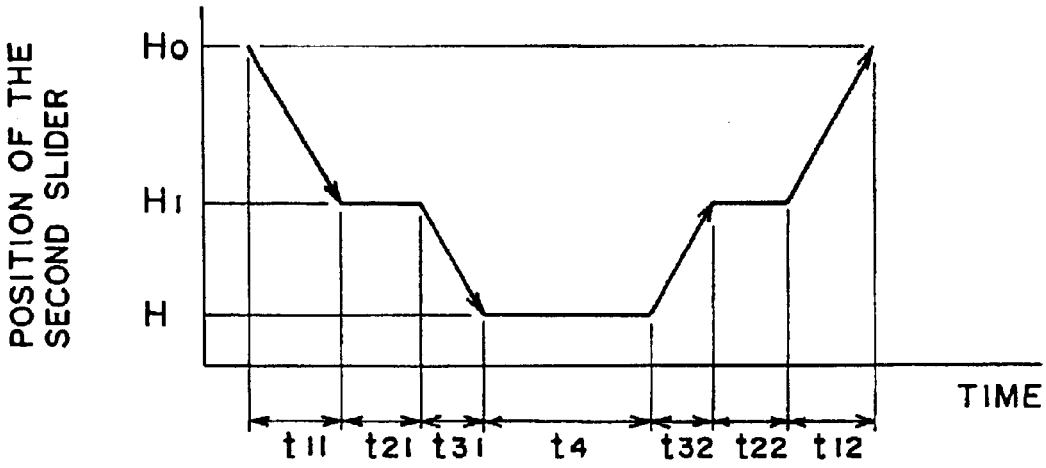
FIG. 2 is an explanatory drawing that schematically shows the relationship between the position of second slider 65 shown in FIG. 1 and time.

FIG. 2 is an explanatory drawing that schematically shows the relationship between the position of the second slider 65 shown in FIG. 1 and time. Operation is described below by referring to FIGS. 1 and 2.

First, through the use of the input device 79, data on the positions $H_0$, $H_1$ and H of the second slider 65 and data on stop time $t_{21}$ (during descent), $t_{22}$ (during ascent) and $t_4$ at the respective positions H1 and H of the second slider 65 are input to the central processing unit 74 and stored there. Next, when the first motor 66 is operated under instructions from the central processing unit 74 with the second motor 67 kept locked, the first slider 64 and second slider 64 descend without mutual relative movement and the second slider 65 reaches the position $H_1$ after the lapse of time $t_1$. The position at this point of time is detected by the detecting element 73 and the linear scale 72 and is input to the central processing unit 74 via the pulse counter 78, with the result that the first motor 66 stops and is locked. During the operation of the first motor 66, control is performed so that the second motor 67 is in a locked condition.

Next, after the lapse of time $t_{21}$ the second motor 67 is operated, whereby the second slider 65 reaches a final position H after the lapse of time $t_{31}$ and the second motor 67 stops. Prescribed press working is performed by the dies 70 and 71 within time $t_4$. This press working may extend to the time $t_{31}$ during which the second slider is descending.

After the completion of the above press working, the operation of the second motor 67 in a reverse direction causes the second slider 65 to reach the position $H_1$ after the lapse of time $t_{32}$ and the second motor 67 stops and is locked. And after the lapse of time $t_{22}$, the operation of the first motor 66 in a reverse direction causes the second slider 65, along with the first slider 64, to reach the initial position $H_0$ after the lapse of time $t_{12}$ and the first motor 66 stops.

The control of the first motor 66 and second motor 67 is performed by feedback from the central processing unit 64 and the position sensor. In this case, it is also possible to make the time $t_{21}$, $t_{22}$ and $t_4$ zero. Furthermore, the second motor 67 can also be operated before the second slider 65 reaches the position $H_1$, and after the completion of working, the first motor 66 and second motor 67 can be simultaneously operated in reverse directions.

Moreover, by appropriately selecting the number of revolutions of the first motor 66 and second motor 67 and the pitch of the screw shafts 68 and 69, it is possible to ensure the relationship between the amount of movement, $m_1$, of the first slider 64 per unit of time and the amount of movement, $m_2$, of the second slider 65 per unit time is $m_1>m_2$. By forming a pressure device as in this example, the die 70 can be moved to the neighborhood of the working position in a short period of time and the accuracy of the subsequent positioning can also be improved. At the same time, as will be described later, a pressing force much larger than by a single slider can be obtained.

Figure 3:
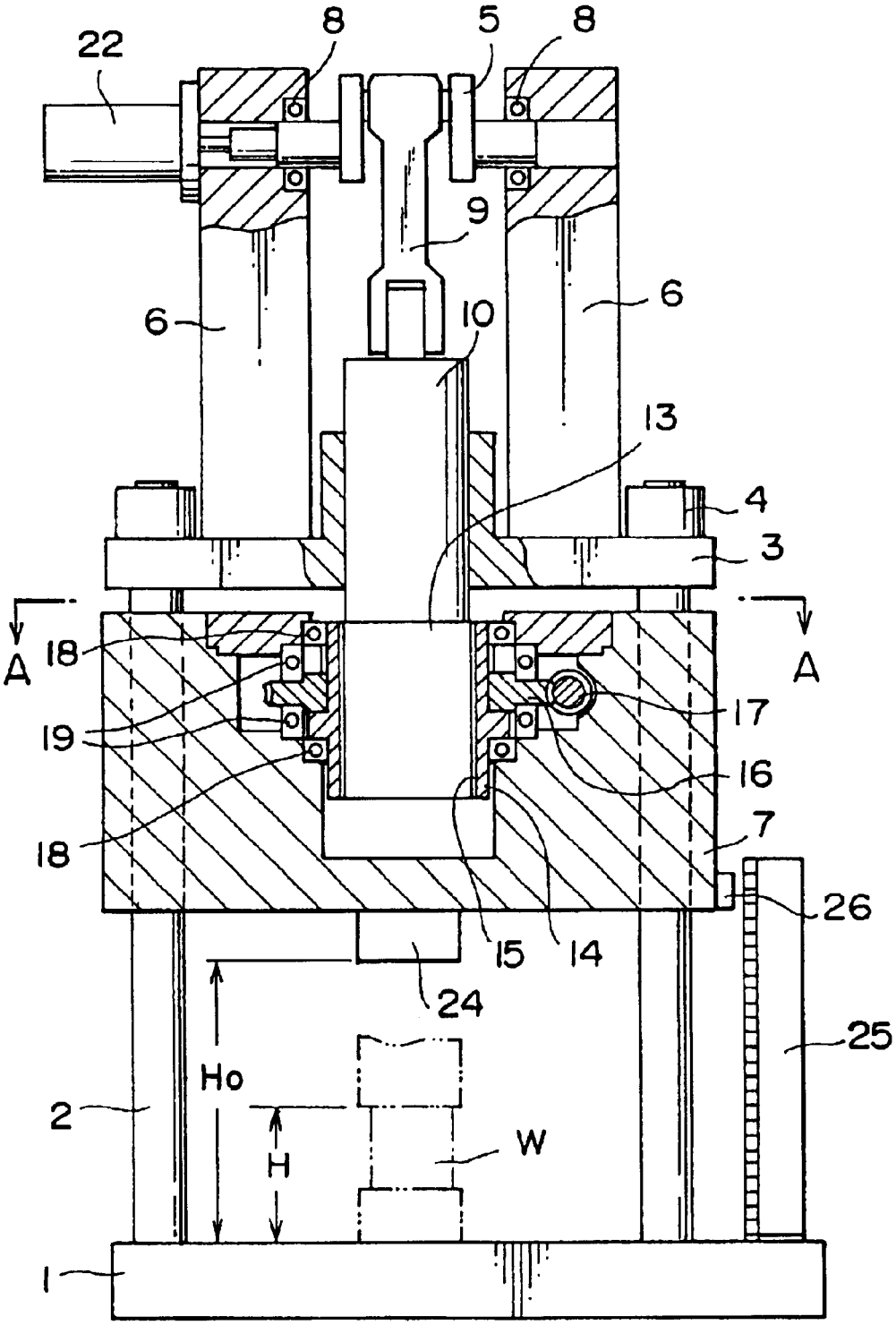
FIG. 3 is a front view in longitudinal section of the essential portions of a second embodiment of the present invention.
Figure 4:
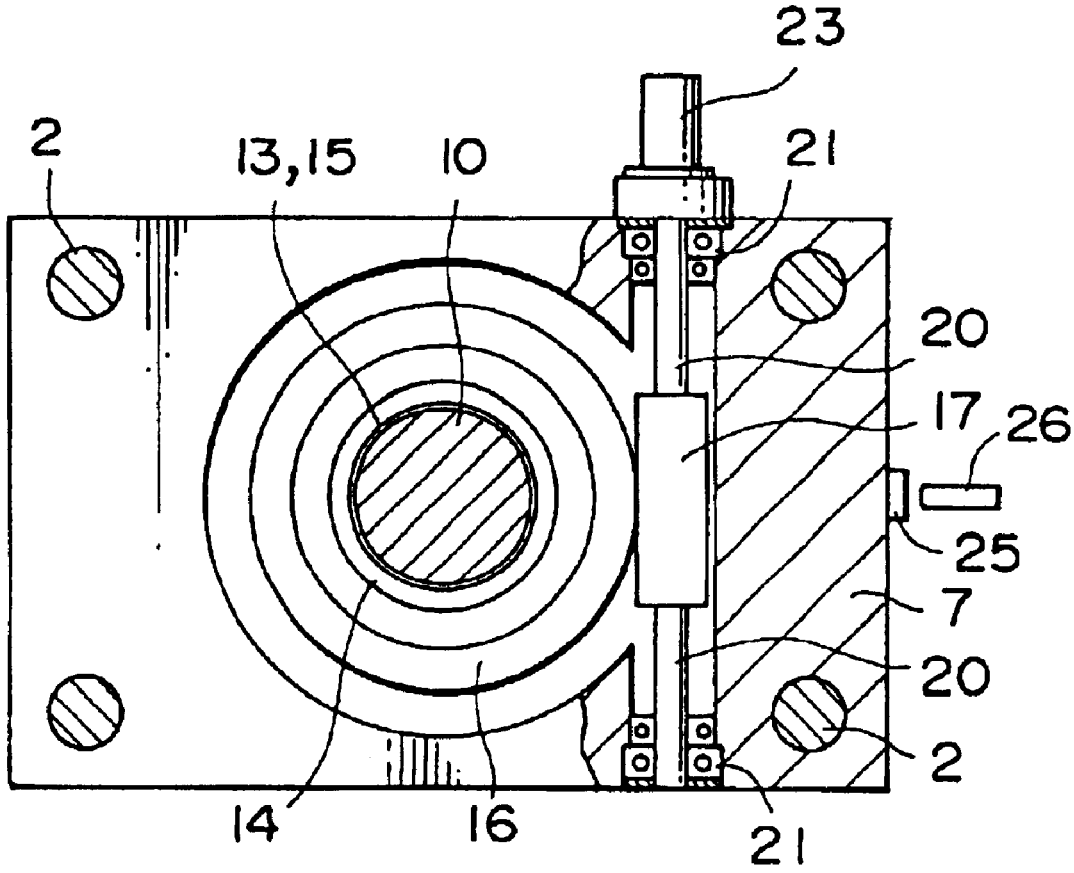
FIG. 4 is a plane view in section of the essential portions taken along the lines A—A of FIG. 3.

FIG. 3 is a front view in longitudinal section of the essential portions of a second embodiment of the present invention and FIG. 4 is a plane view in cross section of the essential portions taken along the lines A—A of FIG. 3. In the two drawings, numeral 1 indicates a base plate 1. The base plate 1 is formed, for example, in rectangular flat-plate form and cylindrical guide bars 2, for example, are provided at the four corners of the base plate 1. A support plate 3 formed in rectangular flat-plate shape, for example, is rotatably fitted to the top end of the guide bar 2 via fastening members 4, for example.

Next, numeral 5 indicates a crankshaft. The crankshaft 5 is rotatably provided between a pair of support members 6 provided on the support plate 3 via bearings 8 and is connected, via a connecting rod 9, to a quill 10 installed in such a manner as to pierce through the support plate 3. Numeral 7 indicates a slider. The slider 7 engages with the guide bar 2 in such a manner as to be movable in the axial direction of the guide bar 2. Numeral 13 indicates a differential male screw. The differential male screw 13 is integrally joined to the bottom end of the quill 10.

Numeral 14 indicates a differential member. The differential member 14 is formed in hollow cylindrical shape and is provided, on the inner peripheral surface, with a differential female screw 17 engaging with the differential male screw 13. Numeral 16 indicates a worm wheel. The worm wheel 16 is integrally fixed to the differential member 14 and is formed in such a manner as to engage with a worm 17. Numerals 18 and 19 indicate a radial bearing and a thrust bearing, respectively. The radial bearing 18 and the thrust bearing 19 are installed within the slider 7 and support the differential member 14 and the worm wheel 16, respectively.

Numeral 20 indicates a worm shaft. The worm shaft 20 is inserted into the center of the worm 17 and is fixed to it. At the same time, both ends of the worm shaft 20 are rotatably supported by bearings 21 installed within the slider 7. Numerals 22 and 23 indicate pulse motors. The pulse motors 22 and 23 are provided in such a manner as to cause the crankshaft 5 and the worm shaft 20, respectively, to rotate. Numeral 24 indicates a pressing element. The pressing element 24 is detachably provided in the bottom end portion of the central portion of the slider 7. Numeral 25 indicates a linear scale provided on the base plate 1, for example, facing a detecting element 26 provided in the slider 7, thereby forming a position sensor of the slider 7.

Note that the pulse motors 22 and 23 are each connected to a central processing unit as shown in FIG. 1 via a driver and an interface (not shown in the figures). The same also applies to the linear scale 25 and detecting element 26 that constitute the position sensor. The differential male screw 13 and the slider 7 shown in FIGS. 3 and 4 correspond to the first slider 64 and second slider 65, respectively, shown in FIG. 1. And the pulse motors 22 and 23 shown in FIGS. 3 and 4 correspond to the first motor 66 and second motor 67, respectively, shown in FIG. 1.

Figure 5:
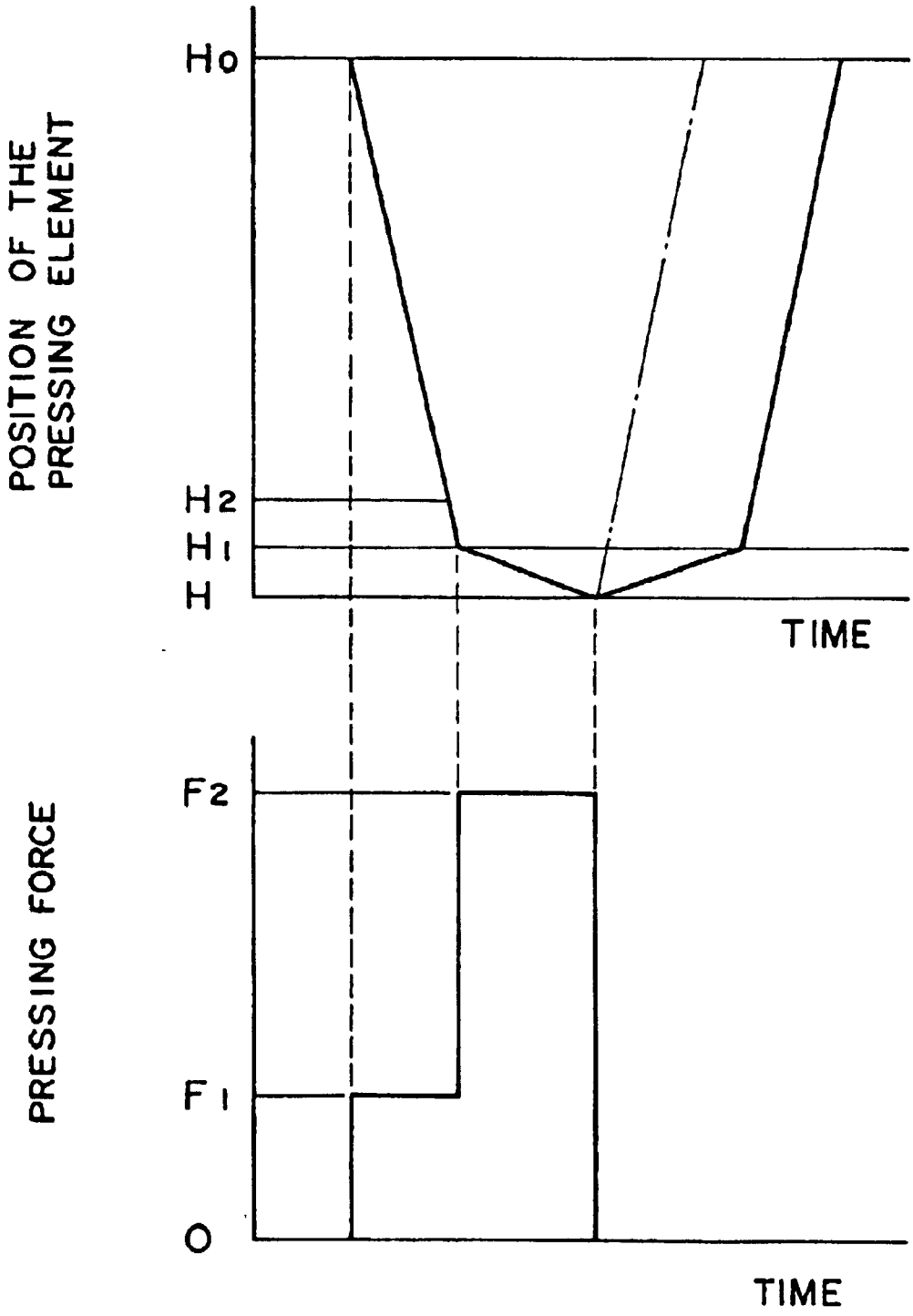
FIG. 5 is an explanatory drawing that schematically shows the relationship between the position of the pressing element 24 shown in FIGS. 3 and 4 and time and the relationship between pressing force and time.
Figure 6:
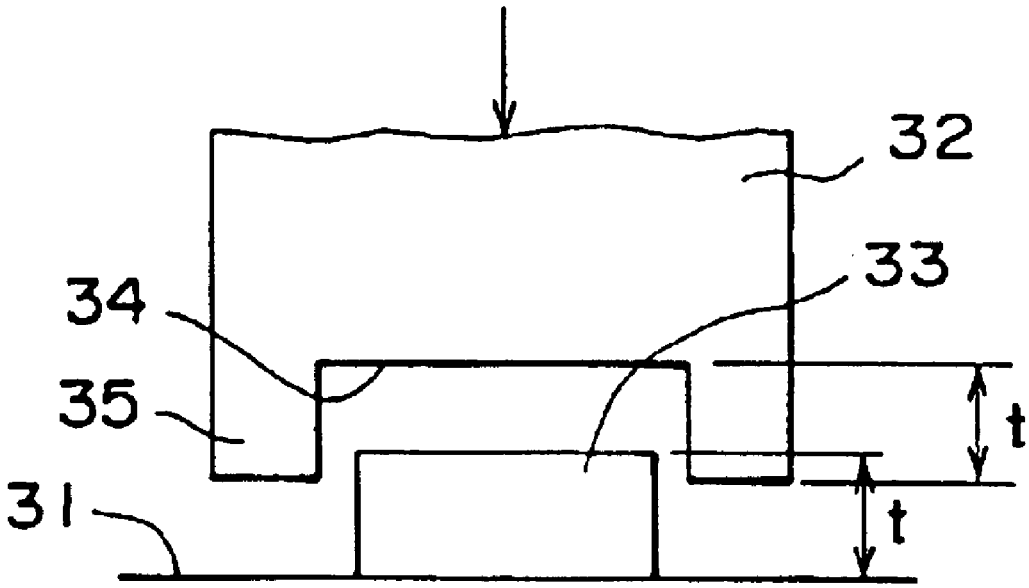
FIG. 6 is an explanatory drawing of conventional press working.
Figure 7:
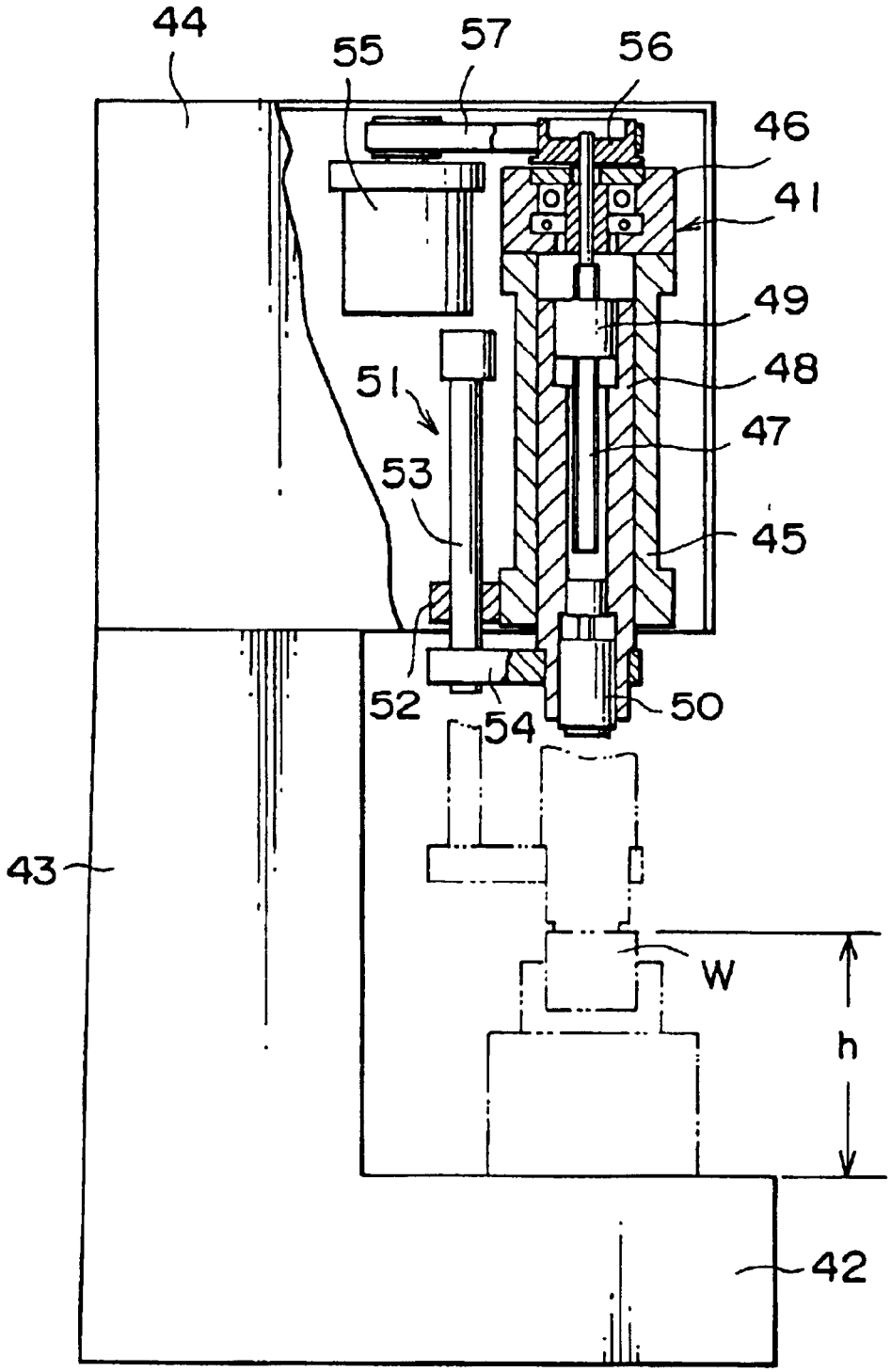
FIG. 7 is a longitudinal sectional view of essential portions in an example of the conventional electrically-driven press.
Figures 8, 9:
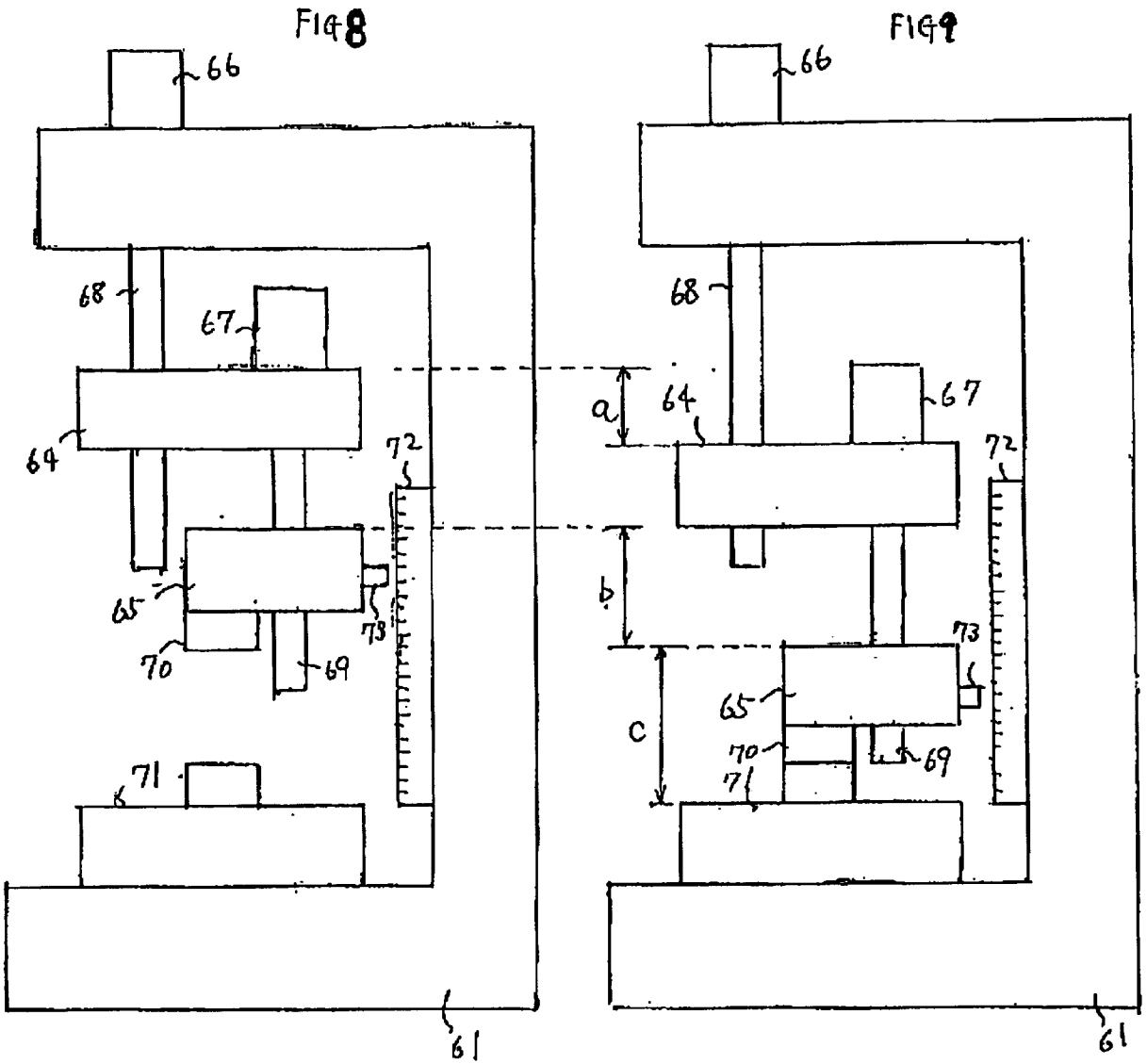
FIG. 8 is a view in longitudinal section of the essential portions of the first embodiment of the present invention that schematically shows second slide 65 shown in FIG. 1 at position $H_0$ of FIG. 2.
FIG. 9 is a view in longitudinal section of the essential portions of the first embodiment of the present invention that schematically shows second slide 65 shown in FIG. 1 at position $H_1$ of FIG. 2.
Figure 10:
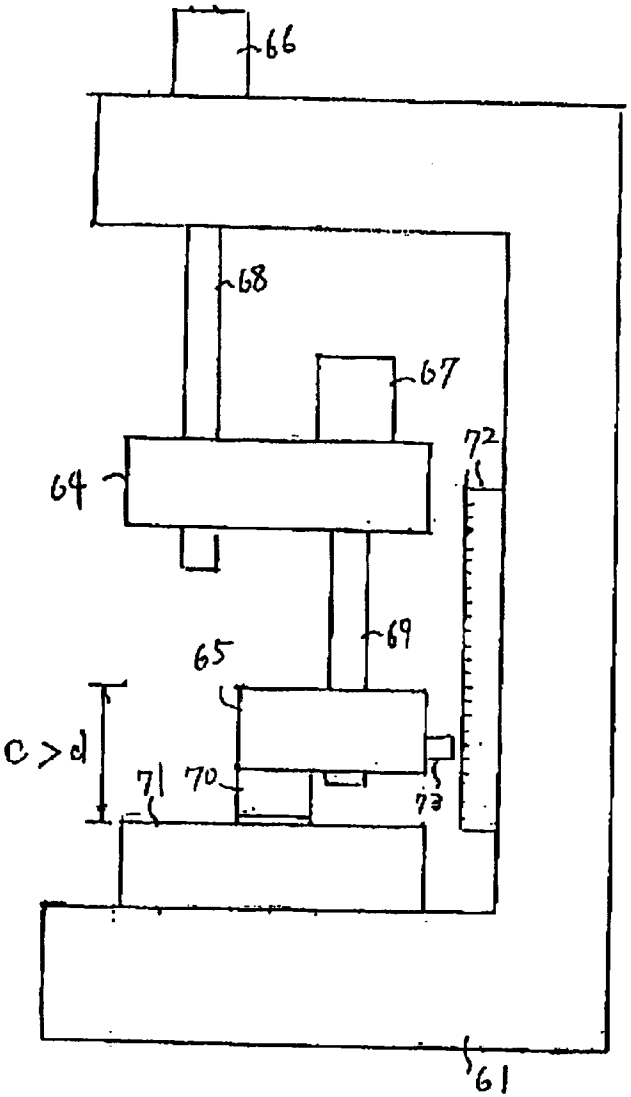
FIG. 10 is a view in longitudinal section of the essential portions of the first embodiment of the present invention that schematically shows second slide 65 shown in FIG. 1 at position H of FIG. 2.

FIG. 5 is an explanatory drawing that schematically shows the relationship between the position of the pressing element 24 shown in FIG. 3 and time, and the relationship between pressing force and time. Operation is described below by referring to FIG. 3 or 5.

First, when the pulse motor 22 is operated by applying a predetermined number of pulses, the crankshaft 5 rotates and the slider 7 descends via the connecting rod 9, the quill 10 and the differential male screw 13, with the result that the pressing element 24 descends from the initial position $H_0$ (upper dead center) to the position $H_1$ (lower dead center of the connecting rod 9 or the differential male screw 13) near the working position H and the pulse motor 22 stops in this position.

Next, when the pulse motor 23 is operated by applying a predetermined number of pulses, the worm shaft 20, the worm 17 and the worm wheel 16 rotate and the differential member 14 rotate. As a result, the pressing element 24 descends from the above position $H_1$ to the working position H and abuts against the workpiece W. As a result, the press working of the workpiece W is performed by a pressing force that is set beforehand via the pressing element 24.

After the completion of press working, the slider 7 ascends by a reverse operation of the pulse motor 23 and the pressing element 24 ascends from the working position H to the position $H_1$. The pressing element 24 then returns to the initial position $H_0$ by a reverse operation of the pulse motor 22. The pressing element 24 may be returned as indicated by chain lines in FIG. 5 by a simultaneous reverse operation of the pulse motors 22 and 23 after the completion of press working.

The pressing force applied by the pressing element 24 to the workpiece W during the above descent of the slider 7 increases substantially from $F_1$ by the pulse motor 22 to $F_2$ by the pulse motor 23. This is because the rotational speed by the pulse motor 23 is substantially reduced due to a reduction gear ratio between the worm 17 and the worm wheel 16 and, therefore, a transmitted torque increases to a reverse multiple of the above reduction gear ratio. Because the pressing force applied to the workpiece W can be substantially increased as mentioned above, the capacity of the pulse motor 23 may be small.

The movement of the pressing element 24 from the position $H_1$ to the position H in FIG. 5 is performed at a slow speed because this movement is due to the rotation of the worm 17 and the worm wheel 16 and the engagement between the differential male screw 13 and the differential female screw 15 in FIGS. 3 and 3. However, because ($H_1$-H), i.e., the working stroke is, for example, about 2–5 mm, the working time does not becomes unwantedly long. On the other hand, when the working stroke is long, the working time can be shortened by starting the operation of the pulse motor 23 in the position $H_2$ of pressing element 24 and causing the pressing element 24 to descend in collaboration with the pulse motor 22. The above values of $H_0$, $H_1$, $H_2$ and H are measured by the linear scale 25 and detecting element 26, which constitute a position sensor, and are input to a central processing unit (not shown). These values can be adapted in such a manner as to be controlled with respect to the pulse motors 22 and 23.

In this case, the stroke given by the crankshaft 5 to the slider 7 as a maximum value is the distance between the upper and lower dead centers of the crankshaft 5. However, it is possible to set the stroke of the slider 7 to a desired value of less than the above maximum value by stopping the crankshaft 5 without causing it to rotate up to the upper dead center.

In the above embodiments of the present invention, description has been made of what is called a vertical type in which the base plate 1 and support plate 3 are arranged parallel to a horizontal plane and the guide bar 2 connecting the two is vertically installed. However, the present invention can be applied to what is called a horizontal type in which the base plate and support plate are arranged parallel to the vertical plane and the guide bar is horizontally installed.

Although in the above description, an arrangement in which the slider 7 is present above the workpiece W was shown, the operation is the same also in an arrangement in which the slider 7 is present under the workpiece W.

Furthermore, an example of speed reducing mechanism by a worm and worm wheel was shown as a means for relative movement of the differential male screw 13 with the slider 7. However, the relative movement means is not limited to this example and a known gear group in which a speed reducing mechanism comprises three or more gears can be used.

In the above embodiments, descriptions were furnished with the aid of the drive motors of crankshaft 5 and worm shaft 20 as pulse motors. However, the drive motors may be servo motors capable of the detection and control of position.

Furthermore, for the guide bar 2 that guides the movement of the slider 7, it is preferred that two or more guide bars be used when a large-size guide bar or a guide bar requiring rigidity is needed. However, a single guide bar may be used or in some cases the guide bar 2 may be formed in columnar or beam form in such a manner that the slider 7 slides along the side of the guide bar 2.

Moreover, in addition to a case where the pressure device of the present invention is used singly, the present invention can naturally be applied to a case where two or more units are arranged in tandem and, for example, a long workpiece is subjected to progressive working. In addition to a use in the sheet metal working of plate materials, the pressure device of the present invention can also be used in the assembling, press-fitting, staking and other working of a plurality of parts, and further for the clamping of molds in an injection molding machine, die casting, powder metallurgy, etc.

INDUSTRIAL APPLICABILITY

Because of the above-mentioned essential features and operation, the present invention can provide the following effects:

(1) A large pressing force can be obtained since the pressing force applied to a workpiece or a body to be pressed increases to a reverse multiple of the reduction gear ratio by the speed reducing mechanism.

(2) The motor that drives the slider may be of a small capacity and, therefore, the driving energy can be substantially reduced.

(3) The stroke from the end point of movement to the start point of movement of the reciprocal drive means can be arbitrarily set.

(4) The bottom dead center of the slider can be accurately controlled and, therefore, working accuracy can be increased.

(5) Noises as in a fluid pressure-operated pressure device are not generated and, therefore, a quiet working environment can be ensured.

What is claimed is:

1. A pressure device comprising a base plate, a support plate spaced at a prescribed distance from the base plate, a first slider and a second slider; the first slider and second slider being formed so that the two can move between the base plate and the support plate in a direction orthogonal to the base plate and the support plate and are capable of relative movement with each other in that direction, a position sensor for detecting the moving position of the second slider, a first drive means for driving the first slider, a second drive means disposed on the first slider for driving the second slider, and a central processing unit which controls the first drive means and the second drive means and receives and processes position signals from the position sensor, wherein a workpiece being pressed which is placed between the second slider and the base plate is pressed until the workpiece reaches a prescribed position by moving the second slider to a prescribed position by use of the second drive means based on position signals from the position sensor, while moving the first slider and the second slider by use of the first drive means.

2. A pressure device according to claim 1, wherein the base plate and support plate are disposed parallel to the horizontal plane and the first slider and the second slider are disposed so that the two can move in a vertical direction.

3. A pressure device according to claim 1, wherein the first drive means is formed as a crank mechanism and the second drive means as a mechanism comprising a screw pair.

4. A pressure device according to claim 1, wherein the first drive means and the second drive means are each formed as a mechanism comprising a screw pair.

5. A pressure device according to claim 4, wherein the screw in the first drive means is formed as a ball screw.

6. A pressure device according to claim 1, wherein the first slider and the second slider are disposed so that the relationship between the amount of movement, m1, of the first slider per unit time and the amount of movement, m2, of the second slider per unit time is expressed by m1>m2.

7. A pressure device according to claim 1, wherein motors in the first drive means and the second drive means are formed as servo motors.

8. A method for pressing a work piece precisely, the method comprising the steps of:

providing a base plate having a plane;

providing a first drive means connected to said base plate wherein a work space is provided between said base plate and said first drive means;

providing a first slider provided within said work spare and connected to said first drive means by a first linearly displacing means having an axis orthogonal to said plane of said base plate;

providing a second drive means connected to said first slider;

providing a second slider provided within said work space and connected to said second drive means by a second linearly displacing means having an axis orthogonal to said plane of said base plate;

providing a position sensor;

providing a central processing unit;

using said first driving means to actuate said first slider and said second slider to bring the second slider in contact with the work piece;

setting said position sensor to initial stage using said second driving means to actuate said second slider to start molding the work piece;

sending position from position sensor to said central processing unit; and controlling said second driving means by said central processing unit to press the work piece evenly and precisely.

9. A method according to claim 8, wherein said first drive means is a crank mechanism and said second drive means is a mechanism comprising a screw pair.

10. A method according to claim 8, wherein said first drive means and said second drive means are each a screw pair.

11. A method according to claim 10 wherein said screw pairs in said first drive means is a ball screw.

12. A method according to claim 8, wherein said first slider and said second slider are actuated so that said first slider moves in greater proportion than said second slider.

13. A method according to claim 8, wherein said first drive means and said second drive means are servo motors.

* * * * *